United States Patent [19]

Landreth

[11] 4,318,249

[45] Mar. 9, 1982

[54] GRIPPABLE SLIDING SEAL STRIP

[75] Inventor: Philip R. Landreth, Wheaton, Ill.

[73] Assignee: Schlegel Corporation, Rochester, N.Y.

[21] Appl. No.: 125,196

[22] Filed: Feb. 27, 1980

[51] Int. Cl.[3] ..... E06B 7/22

[52] U.S. Cl. ..... 49/490; 49/485; 49/491; 491/497

[58] Field of Search ..... 49/490, 491, 497, 485, 49/475, 493

[56] References Cited

U.S. PATENT DOCUMENTS

| | | | |
|---|---|---|---|
| 2,664,602 | 1/1954 | Bright | 49/491 |
| 2,913,783 | 11/1959 | Bright | 49/491 |
| 2,968,072 | 1/1961 | Bright | 49/491 |
| 2,974,383 | 3/1961 | Bright | 49/491 X |
| 3,175,256 | 3/1965 | Horton | 49/493 X |
| 3,359,688 | 12/1967 | Konolf | 49/490 |
| 3,742,649 | 7/1973 | Dochnahl | 49/491 |
| 4,042,741 | 8/1977 | Bright | 49/490 X |
| 4,114,320 | 9/1978 | Pulian | 49/491 |
| 4,143,497 | 3/1979 | Offenbacher | 49/490 X |

*Primary Examiner*—Philip C. Kannan
*Attorney, Agent, or Firm*—Cumpston & Shaw

[57] ABSTRACT

A channel-shaped gripping element and a pile seal member are secured together to provide a grippable sliding seal strip. The gripping element is secured to a flange of a fixed member, and the pile seal member slidably engages the surface of a moving member. A flexible link member is interposed between the gripping element and the pile seal member. A guard arm is provided on one of the gripping elements and pile seal members for preventing penetration of the pile by flying foreign objects.

3 Claims, 7 Drawing Figures

GRIPPABLE SLIDING SEAL STRIP

BACKGROUND OF THE INVENTION

1. Field of the Invention

The present invention relates generally to seals, and more particularly to sliding seals of the type wherein sliding motion between the seal and another member occurs. The sliding seal of this invention comprises a pile seal member secured to a channel-shaped gripping element. A protective arm-guard extends from one of the pile seal members or gripping elements to prevent penetration of the pile by foreign material such as stones or the like.

2. Description of the Prior Art

U.S. Pat. No. 3,175,256 relates to a weather-seal having a base strip and two longitudinally extending parallel spaced rows of pile attached to the base strip. An impervious fin of thermoplastic material is secured on edge to the base strip in the space between the rows of pile.

U.S. Pat. No. 3,198,689 discloses a weatherseal mountable on a flange around a door or window opening in a motor vehicle body to prevent water and air leakage into the body. The weatherseal comprises a channel member having gripping means by which the seal is mounted on the flange. The gripping means comprises gripping ribs extending longitudinally along the inside surface of the channel member, projecting toward each other from the opposite side walls thereof. Although only one rib is shown on each side wall, it is known in the art to provide more than one, if desired.

U.S. Pat. No. 4,114,320 discloses a door seal having a channel-shaped gripping element, and a tubular seal secured to a portion of the outer surface of the channel-shaped element.

It is further known in the prior art to provide a longitudinally extending deformable seal such as a rubber gasket or the like for sealing a swingable refrigerator door. The seal is secured to the door frame by any suitable means, and is sealingly engaged by a surface of the door when it is swung to its closed position.

Although the deformable seal provides an adequate seal for swingable doors, it is unsatisfactory for roll-up type overhead doors in refrigerated trucks, trailers or box cars. One of the problems is that the sliding motion between the deformed or compressed seal and the door surface results in abrasion which is potentially damaging to the seal and door. Seal damage can result in air leakage. This, in turn, can increase the work load on the refrigerator system and its cost of operation. In addition, possible damage to the refrigerated perishable product can result, particularly if the refrigeration system breaks down.

Leaf seals are also known in the art for sealing the space between the surface of a roll-up door and the door frame. One problem with this type of seal, in addition to the abrasion problem noted above, is that the unevenness or irregularities in the roll-up door surface prevents securing a good seal. Another problem is that the leaf seal is oriented to offer more resistance to inward air flow than outward resulting in possible loss of refrigerated air outwardly through the seal.

SUMMARY OF THE INVENTION

In accordance with this invention, preferred embodiments of a grippable sliding seal strip are disclosed for sealing the space between a fixed frame such as a door frame and a sliding member such as a roll-up overhead door. The seal strip comprises an elongated channel-shaped element mountable on the fixed frame. A base strip is secured to a portion of the outer surface of the channel-shaped element. A longitudinally extending row of pile has one surface thereof secured to the base strip. The opposite free surface of the pile slidably engages the sliding member.

In another aspect of the invention, the seal strip has a flexible link member connecting the base strip to the portion of the outer surface of the channel-shaped element.

In more specific aspects of the invention, the flexible link member can be a flexible rib, or a flexible tubular member.

In another aspect of the invention, the seal strip is provided with a guard arm extending from the channel-shaped element or the base strip toward the sliding member for preventing foreign material such as stones from penetrating and damaging the pile of the seal member.

In more specific aspects of the invention, the guard arm is flexible, and comprises the free end of one of the side walls of the channel-shaped element. The guard arm can also comprise the free edge of the base strip, or an arm integral with and extending from the tubular member.

The primary advantage of the aforementioned aspects of the invention is to solve the aforementioned problems of prior art seals interposed between fixed and sliding members. Such problems include, for example, inadequate sealing and extensive abrasion damage of the seal strip and sliding member.

The invention and its advantages will become more apparent from the detailed description of the invention presented below.

BRIEF DESCRIPTION OF THE DRAWINGS

The details of this invention will be described in connection with the accompanying drawings, in which.

DETAILED DESCRIPTION OF THE INVENTION

Figure 1:
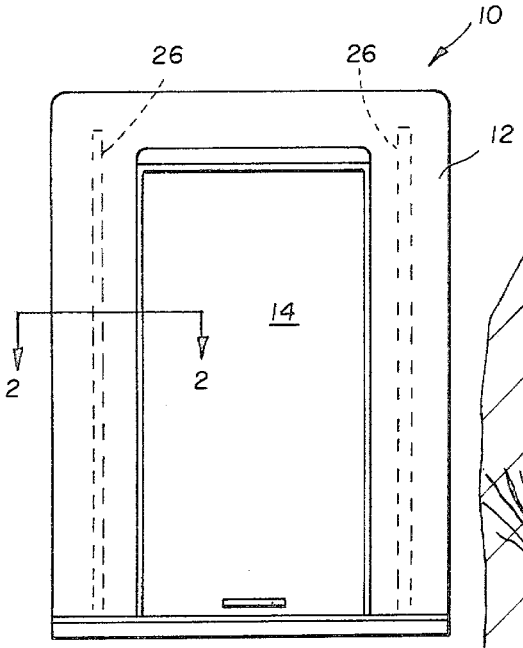
FIG. 1 is a front elevational view of a fixed structure supporting a sliding member shown as a roll-up overhead door.

Referring to FIG. 1 of the drawings, a fixed structure 10 such as a garage or the body of a refrigeration car, truck or trailer is disclosed having a door frame 12 for supporting a sliding member such as a roll-up or overhead door 14. The door is of the conventional type comprising a plurality of parallel, hinged panels, not shown, which allow the door to be vertically oriented, when closed, and substantially horizontally oriented, when opened.

Figure 2:
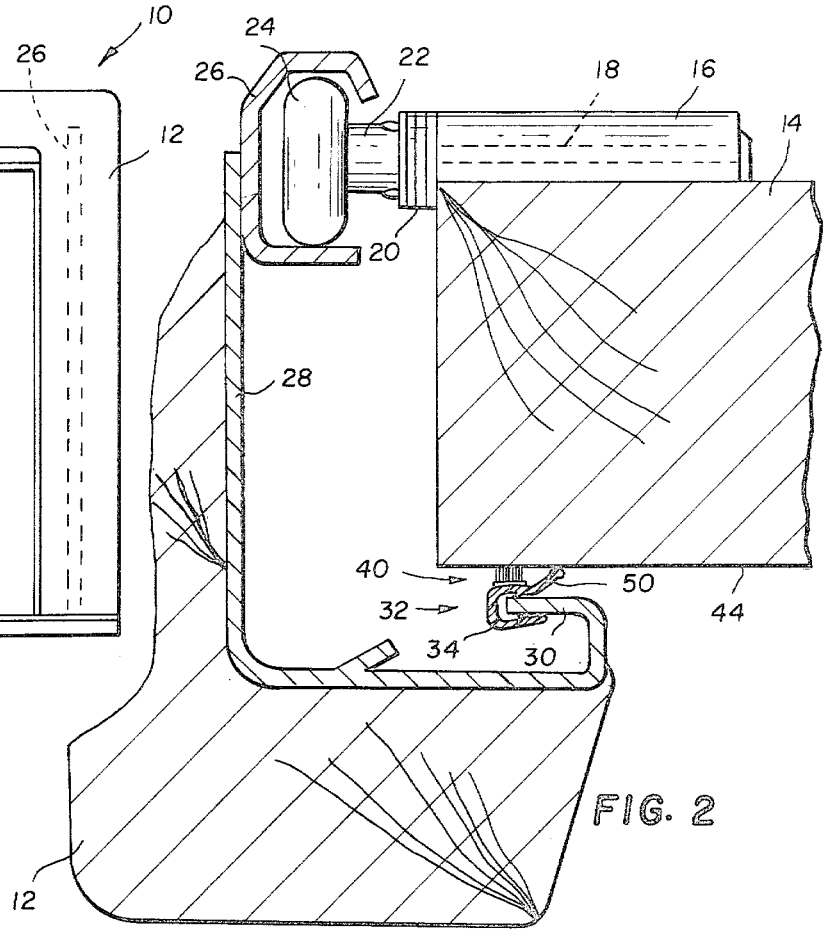
FIG. 2 is an enlarged segmental view taken substantially along line 2—2 of FIG. 1.

With reference to FIG. 2, and as is well known in the art, door 14 is further provided along each side edge with a plurality of spaced housings 16, only one of which is shown, each adapted to pivotally support a shaft 18. A triangular-shaped link plate 20 is secured along one side of the link to one end of each shaft 18, and a laterally extending stub shaft 22 secured to each link opposite the one side rotatably supports a roller 24 on roller-bearings, not shown. The rollers are rotatably captured within elongated, chute-like roller guides 26 arranged in a substantially inverted L-shaped orientation. Each roller guide 26 is mounted on one end of a plate 28 of L-shaped cross-section secured to door frame 12 along each side of the door. The opposite end or flange 30 of plate 28 supports a seal strip 32, to be described more fully with reference to FIG. 3.

Figure 3:
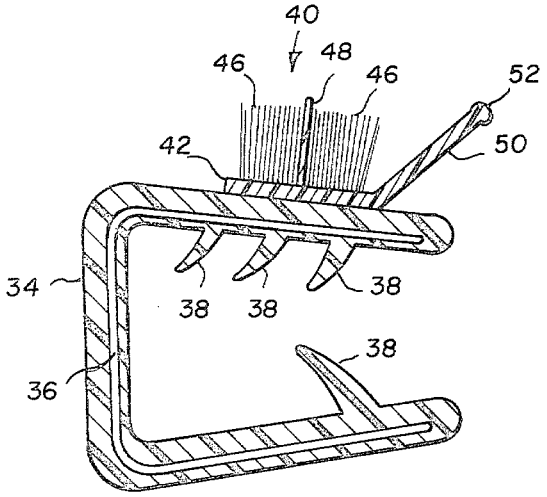
FIG. 3 is an enlarged view in section of the seal strip illustrated in FIG. 2.

Referring to FIG. 3, seal strip 32 comprises an elongated channel-shaped gripping element 34 essentially of the type disclosed and described in U.S. Pat. No. 3,198,689. The channel-shaped element 34 has a wire carrier 36 preferably covered by a flexible polymeric material. The wire carrier strengthens the element and improves its gripping power. The element has gripping ribs 38 formed from any suitable material running along and protruding from the inside surface of each wall of element 34. Gripping ribs 38 help to ensure that seal strip 32 is not inadvertently pulled off the end of flange 30 once it is mounted thereon.

An elongated pile seal member 40 essentially of the type disclosed and described in U.S. Pat. No. 3,175,256 has a base strip 42 of any suitable material secured to a portion of the outer surface of channel-shaped element 34. The portion of the outer surface to which base strip 42 is secured depends upon the orientation of flange 30 relative to outer door surface 44 (FIG. 2). Pile seal member 40 comprises spaced rows of pile 46 secured at one end surface to the base strip, and the opposite free end adapted to slidably engage outer door surface 44. A moisture impervious barrier fin 48 of any suitable material is mounted in the space between the rows of pile 46 with one end thereof preferably secured to base strip 42.

One edge of base strip 42 has an arm 50 transverse to and extending outwardly from the base strip toward and preferably into engagement with outer door surface 44. Arm 50 forms a guard in front of pile 46 extending between flange 30 and outer door surface 44 to prevent foreign objects such as dirt, oil, water or stones from penetrating the pile and damaging it. This is particularly possible in those applications where the seal strip is incorporated on sliding doors of fast moving refrigeration vehicles such as trucks. Arm 50 is preferably flexible and of a length so that in its guard position as seen in FIG. 2, the rounded free end 52 thereof bears against outer door surface 44 with a predetermined pressure.

With reference to the embodiments of seal strip 32 illustrated in FIGS. 4–7, parts similar to parts shown and described in FIG. 3 will be designated by the same numerals.

Figure 4:
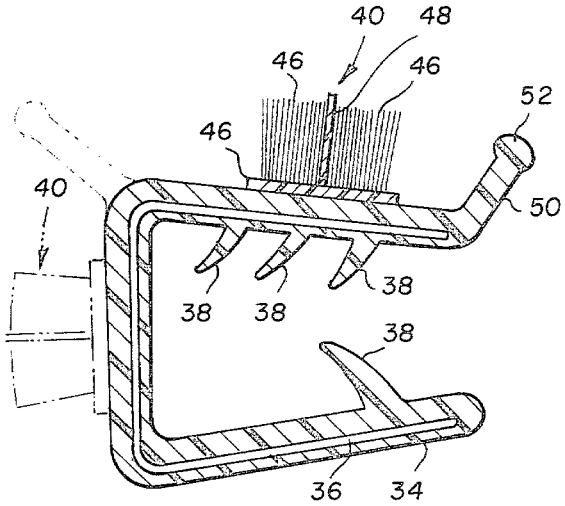
FIGS. 4, 5, 6 and 7 are views similar to FIG. 3 of other embodiments of the seal strip of this invention.

Referring to the FIG. 4 embodiment of the invention, guard arm 50 is integral with and extends outwardly from one of the side walls of channel-shaped element 34. In broken lines, pile seal member 40 is shown in an alternate position for those sealing applications in which plate flange 30 is oriented substantially perpendicular to the outside door surface 44.

Figure 5:
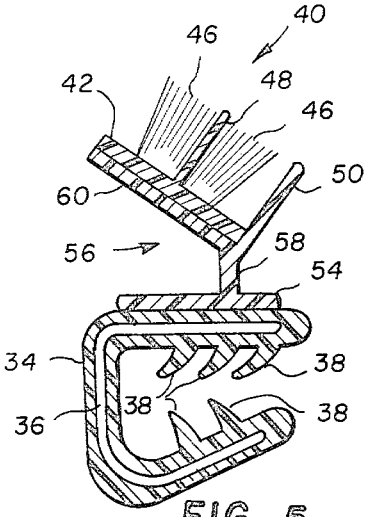

In the embodiment of seal strip 32 illustrated in FIG. 5, a support strip 54 of any suitable material is secured to an outer surface of channel-shaped element 34. A flexible substantially Y-shaped link member 56 preferably formed from any suitable polymeric material has one leg 58 connected to support strip, another leg 60 connected to base strip for supporting pile, and the last leg extending in front of pile 46 to form guard arm 50. Support strip 54 and link member 56 may be extruded as one piece. Link member 56 is further oriented at an angle to outside door surface 44 so that in operation pile seal member 40, leg 60 and arm 50 are flexed for applying sealing pressure against door 14. Link member 56 further serves to deflect in operation to compensate for wide tolerances developed over the functional life of the seal and door.

Figure 6:
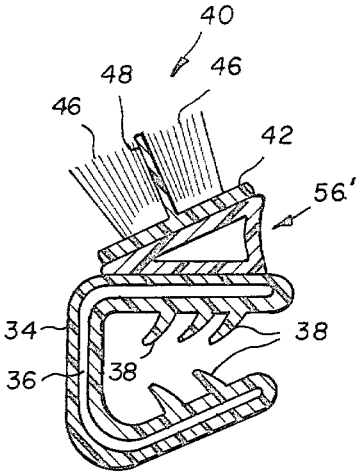
Figure 7:
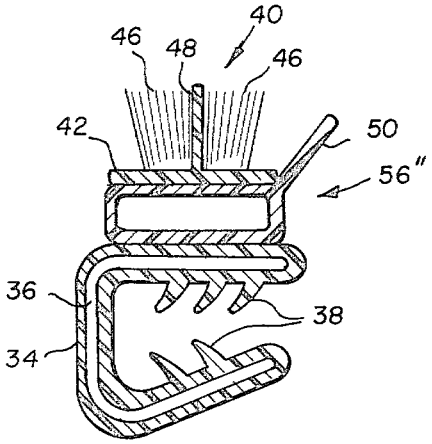

With reference to FIG. 6, flexible link member 56' is tubular, and of a substantially right-triangular cross-section. In FIG. 7, link member 56'' is also tubular, but of a substantially rectangular cross-section. In FIG. 7, guard arm 50 is integral with and extends outwardly from the link member.

Existing door frames on trailers, trucks or the like are provided with vertically extending flanges for, among other things, supporting known leaf type seals. Such door frames may be readily retrofitted with the new grippable sliding seal strip of this invention which requires no fastening means to the existing door frame. The new sliding seal can further be readily replaced when worn out. To provide a continuous seal at the top of the door, a horizontal framing member may be added to the door frame by screws or the like for supporting a flange interposed between the existing vertical flanges. A bulb type seal may be added to the bottom of the door to provide a fully sealed roll-up door sealed on the top, bottom and each side thereof.

While presently preferred embodiments of the invention have been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A seal strip for sealing the space between a fixed frame and a sliding member comprising:

an elongated channel-shaped element adapted to be secured to the fixed frame;

a base strip;

a longitudinally extending row of pile having one surface thereof secured to one side of said base strip and the opposite free surface of said pile adapted to slidably engage the sliding member;

a flexible tubular member connecting the opposite side of said base strip to a portion of the outer surface of said channel-shaped element; and a guard arm integral with and extending from said tubular member toward the sliding member for preventing foreign material from penetrating said pile.

2. A seal strip according to claim 1 wherein said tubular member has a substantially rectangular cross section.

3. A seal strip according to claim 1 wherein said tubular member has a substantially right-triangular cross section.

* * * * *